US012129724B2

(12) United States Patent
Kamphaus

(10) Patent No.: US 12,129,724 B2
(45) Date of Patent: Oct. 29, 2024

(54) GAS LIFT LATCH

(71) Applicant: Schlumberger Technology Corporation, Sugar Land, TX (US)

(72) Inventor: Jason Kamphaus, Missouri City, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 59 days.

(21) Appl. No.: 18/248,909

(22) PCT Filed: Oct. 18, 2021

(86) PCT No.: PCT/US2021/055377
§ 371 (c)(1),
(2) Date: Apr. 13, 2023

(87) PCT Pub. No.: WO2022/082092
PCT Pub. Date: Apr. 21, 2022

(65) Prior Publication Data

US 2023/0392463 A1 Dec. 7, 2023

Related U.S. Application Data

(60) Provisional application No. 63/093,348, filed on Oct. 19, 2020, provisional application No. 63/092,926, filed on Oct. 16, 2020.

(51) Int. Cl.
*E21B 23/03* (2006.01)
*E21B 43/12* (2006.01)

(52) U.S. Cl.
CPC ..... *E21B 23/03* (2013.01); *E21B 43/122* (2013.01); *E21B 43/123* (2013.01)

(58) Field of Classification Search
CPC ..... E21B 43/122; E21B 41/00; E21B 23/03; E21B 32/123; E21B 23/00; E21B 43/123
See application file for complete search history.

(56) References Cited

U.S. PATENT DOCUMENTS

| | | | | |
|---|---|---|---|---|
| 3,074,485 A | | 1/1963 | Mcgowen, Jr. | |
| 3,638,988 A | * | 2/1972 | Brown | E21B 23/02 294/86.18 |
| 3,741,601 A | | 6/1973 | Dudley | |
| 3,827,493 A | * | 8/1974 | Terral | E21B 23/02 166/217 |
| 3,863,961 A | | 2/1975 | Dinning | |
| 3,874,447 A | | 4/1975 | McGowen | |

(Continued)

FOREIGN PATENT DOCUMENTS

| | | |
|---|---|---|
| EP | 0325835 A1 | 8/1989 |
| WO | 2023091705 A1 | 5/2023 |

OTHER PUBLICATIONS

Search Report and Written Opinion of International Patent Application No. PCT/US2022/050464 dated Apr. 5, 2023, 9 pages.

(Continued)

*Primary Examiner* — Young-Suk (Philip) Ro
(74) *Attorney, Agent, or Firm* — Jeffrey D. Frantz

(57) ABSTRACT

A latch design for downhole components is provided. The latch design includes a dog assembly instead of a traditional shear pin design to allow the latch to withstand greater forces and more cycles than the traditional design.

13 Claims, 7 Drawing Sheets

(56) References Cited

U.S. PATENT DOCUMENTS

| | | | | | |
|---|---|---|---|---|---|
| 3,874,448 | A * | 4/1975 | McGowen, Jr. | E21B 23/01 | 294/86.18 |
| 4,265,360 | A * | 5/1981 | Khodos | B65G 47/82 | 198/802 |
| 4,379,488 | A | 4/1983 | Hamm | | |
| 4,454,972 | A * | 6/1984 | Maltby, Jr. | C03B 33/0235 | 225/2 |
| 4,554,972 | A | 11/1985 | Merritt | | |
| 5,058,670 | A * | 10/1991 | Crawford | E21B 43/123 | 166/117.6 |
| 5,205,357 | A | 4/1993 | Terral | | |
| 2006/0137881 | A1 * | 6/2006 | Schmidt | E21B 43/123 | 166/372 |
| 2010/0044055 | A1 * | 2/2010 | Pena | E21B 43/123 | 166/216 |

OTHER PUBLICATIONS

International Search Report and Written Opinion Issued in the PCT Application PCT/US2021/055377, dated Feb. 3, 2022 (11 pages).

* cited by examiner

GAS LIFT LATCH

CROSS-REFERENCE TO RELATED APPLICATIONS

Any and all applications for which a foreign or domestic priority claim is identified in the Application Data Sheet as filed with the present application are hereby incorporated by reference under 37 CFR 1.57. The present application is the National Stage Entry of International Application No. PCT/US2021/055377, filed Oct. 18, 2021, which claims priority benefit of U.S. Provisional Application No. 63/092,926, filed Oct. 16, 2020, and U.S. Provisional Application No. 63/093,348, filed Oct. 19, 2020, the entirety of each of which is incorporated by reference herein and should be considered part of this specification.

BACKGROUND

Field

The present disclosure generally relates to gas lift, and more particularly to a latch design for downhole tools.

Description of the Related Art

Oil and gas wells utilize a borehole drilled into the earth and subsequently completed with equipment to facilitate production of desired fluids from a reservoir. Subterranean fluids, such as oil, gas, and water, are produced from the wellbore. In some cases, the fluid is produced to the surface naturally by downhole formation pressures. However, the fluid must often be artificially lifted from wellbores by the introduction of downhole equipment. Various types of artificial lift are available. In a gas lift system, a compressor is located on the surface. The compressor pumps gas down the casing tubing annulus. The gas is then released into the production tubing via gas valves that are strategically placed throughout the production tubing. The gas that is introduced lightens the hydrostatic weight of the fluid in the production tubing, allowing the reservoir pressure to lift the fluid to surface.

SUMMARY

In some configurations, a latch for a downhole component includes a latch stop forming a base of the latch; a running head coupled to and extending upward from the latch stop; a latch body circumferentially disposed about at least a portion of the running head; a latch ring disposed circumferentially about the latch body and positioned adjacent the latch stop; a dog assembly comprising a shaft disposed radially between the running head and the latch body and one or more dogs disposed at a bottom end of the shaft, the dogs configured to engage corresponding features in the running head; and a lock ring disposed circumferentially about the latch body, wherein in a locked position, the lock ring is positioned at an axial position along the latch body such that the lock ring is radially aligned and disposed about the one or more dogs, the lock ring configured to inhibit the one or more dogs from moving radially outward out of engagement with the corresponding features in the running head, and wherein in an unlocked position, the lock ring is positioned along the latch body axially spaced from the one or more dogs, thereby allowing the one or more dogs to move radially outward out of engagement with the running head.

The latch body can include a locking mechanism configured to engage the lock ring in the unlocked position. The latch can include a safety mechanism positioned along the running head above the latch body. The downhole component can be configured to be partially received in the latch stop. The downhole component can be a gas lift valve. The latch can be configured to couple to a running tool for insertion into a wellbore and/or to a pulling tool for retrieval from the wellbore. The latch can include one or more locking dogs coupled to the latch stop. When the latch and downhole component are installed in a downhole mandrel, the locking dogs can be configured to radially expand to a deployed position to limit and axial range of movement of the latch and downhole component in the mandrel. The locking dogs may be configured to engage the mandrel.

In some configurations, a method for retrieving the latch coupled to a downhole component from a mandrel disposed in a wellbore includes running a pulling tool downhole to contact the latch; pushing the lock ring downward along the latch body to the unlocked position using the pulling tool; and allowing the one or more dogs to move radially outward out of engagement with the running head.

The method can include using the pulling tool to pull upward on the latch body, driving the one or more dogs radially outward. The method can include pulling the latch body and dog assembly upward such that the latch body disengages from and clears the latch ring, allowing the latch ring to move radially inward out of engagement with a lug of the mandrel. The method can include removing the latch and downhole component from the mandrel and wellbore.

In some configurations, a latch for a downhole component includes a running head; a latch body circumferentially disposed about at least a portion of the running head; and a collet assembly; wherein in a locked position, the collet assembly engages the running head, and wherein in an unlocked position, the collet assembly is configured to disengage from the running head to allow the latch body and the collet assembly to move axially relative to the running head.

The latch can further include a latch ring. When the latch is in the locked position, the latch ring is disposed circumferentially about the latch body, and when the latch is in the unlocked position, the latch body is configured to displace axially relative to the latch ring and the latch ring is configured to contract radially inward. The latch can include one or more locking dogs. When the latch and downhole component are installed in a downhole mandrel, the locking dogs are configured to radially expand to a deployed position to limit an axial range of movement of the latch and downhole component in the mandrel. In the deployed position, the locking dogs may be configured to engage the mandrel. The downhole component can be a gas lift valve. The latch can be configured to couple to a running tool for insertion into a mandrel in a wellbore and configured to couple to a pulling tool for retrieval from the mandrel.

BRIEF DESCRIPTION OF THE FIGURES

Certain embodiments, features, aspects, and advantages of the disclosure will hereafter be described with reference to the accompanying drawings, wherein like reference numerals denote like elements. It should be understood that the accompanying figures illustrate the various implementations described herein and are not meant to limit the scope of various technologies described herein.

DETAILED DESCRIPTION

In the following description, numerous details are set forth to provide an understanding of some embodiments of the present disclosure. It is to be understood that the following disclosure provides many different embodiments, or examples, for implementing different features of various embodiments. Specific examples of components and arrangements are described below to simplify the disclosure. These are, of course, merely examples and are not intended to be limiting. However, it will be understood by those of ordinary skill in the art that the system and/or methodology may be practiced without these details and that numerous variations or modifications from the described embodiments are possible. This description is not to be taken in a limiting sense, but rather made merely for the purpose of describing general principles of the implementations. The scope of the described implementations should be ascertained with reference to the issued claims.

As used herein, the terms "connect", "connection", "connected", "in connection with", and "connecting" are used to mean "in direct connection with" or "in connection with via one or more elements"; and the term "set" is used to mean "one element" or "more than one element". Further, the terms "couple", "coupling", "coupled", "coupled together", and "coupled with" are used to mean "directly coupled together" or "coupled together via one or more elements". As used herein, the terms "up" and "down"; "upper" and "lower"; "top" and "bottom"; and other like terms indicating relative positions to a given point or element are utilized to more clearly describe some elements. Commonly, these terms relate to a reference point at the surface from which drilling operations are initiated as being the top point and the total depth being the lowest point, wherein the well (e.g., wellbore, borehole) is vertical, horizontal or slanted relative to the surface.

Figure 1:
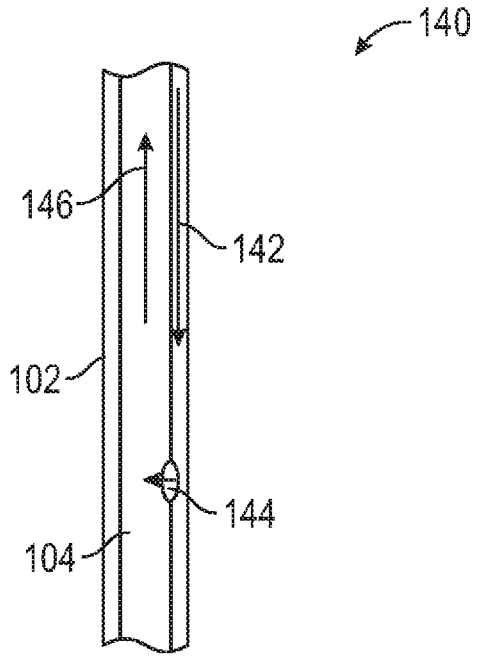
FIG. 1 schematically illustrates a portion of an example gas lift system.

FIG. 1 illustrates a downhole portion of an example gas lift system 140. The gas lift system 140 includes a compressor located at the well surface. In use, the compressor pumps gas down the annulus between the casing 102 and the tubing 104, as indicated by arrow 142. The gas is then released into the tubing 104 via one or more gas valves 144 that are strategically placed throughout the tubing 104. The gas lessens the hydrostatic weight of the fluid in the tubing 104, allowing the reservoir pressure to lift the fluid to the surface, as indicated by arrow 146.

The present disclosure provides a latch for downhole tools. Latches according to the present disclosure can be used in gas lift. However, the latches can also be used in various other applications, for example, in any case in which a latch is needed to aid in conveyance, to prevent a tool from dislodging during operations, and/or to aid in retrieval of the tool.

Figure 2:
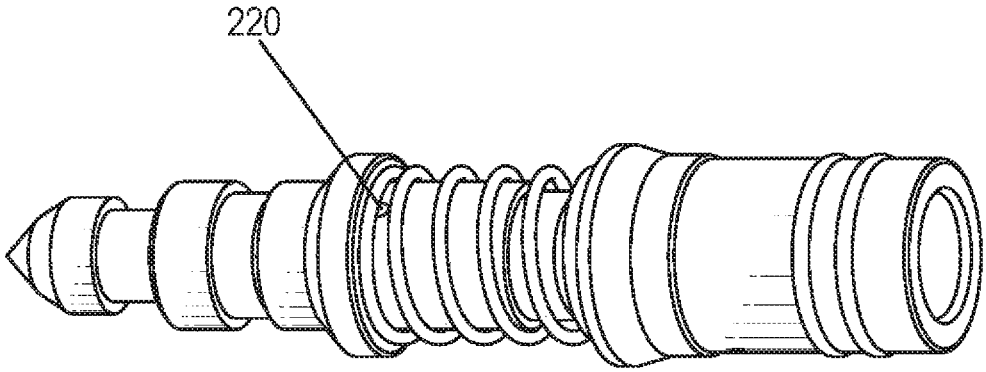
FIG. 2 illustrates a perspective view of an example existing latch.
Figure 4:
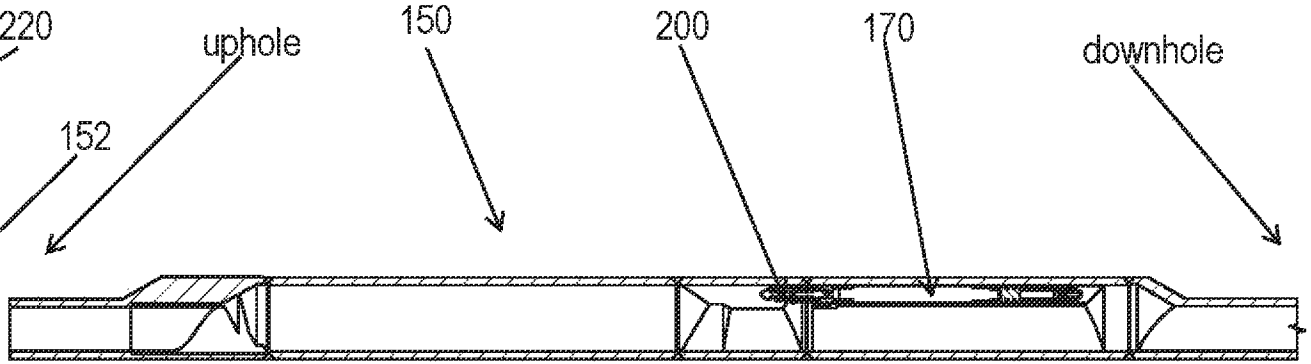
FIG. 4 illustrates a longitudinal cross-section of the valve and latch assembly of FIG. 3 disposed in a mandrel.
Figure 3:
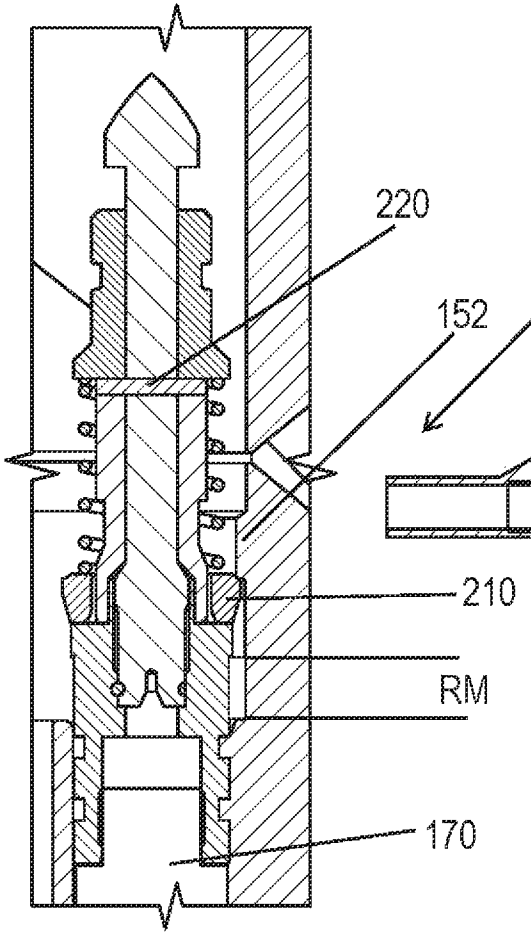
FIG. 3 illustrates a longitudinal cross-section of an assembly including the latch of FIG. 2 and a valve.

FIGS. 2-4 illustrate a standard latch design. As shown, the latch 200 includes a latch ring 210 and a shear pin 220. The latch is configured to be coupled to a downhole component, such as a valve 170 as shown in the configuration of FIG. 3. In use, the assembly of the latch and downhole component, e.g., the valve 170 in the illustrated configuration, can be disposed in a mandrel 150, for example as shown in FIG. 4. The latch can move up and down by a distance or range of movement RM shown in FIG. 3, which is determined by features of the latch and mandrel 150. The range of movement allows the latch and component (e.g., valve) assembly to accelerate, for example as the assembly is conveyed into the well and the mandrel 150, until the latch ring 210 impacts a mandrel lug 152, as shown in FIG. 3, resulting in dynamic loading of the shear pin 220.

Figure 10:
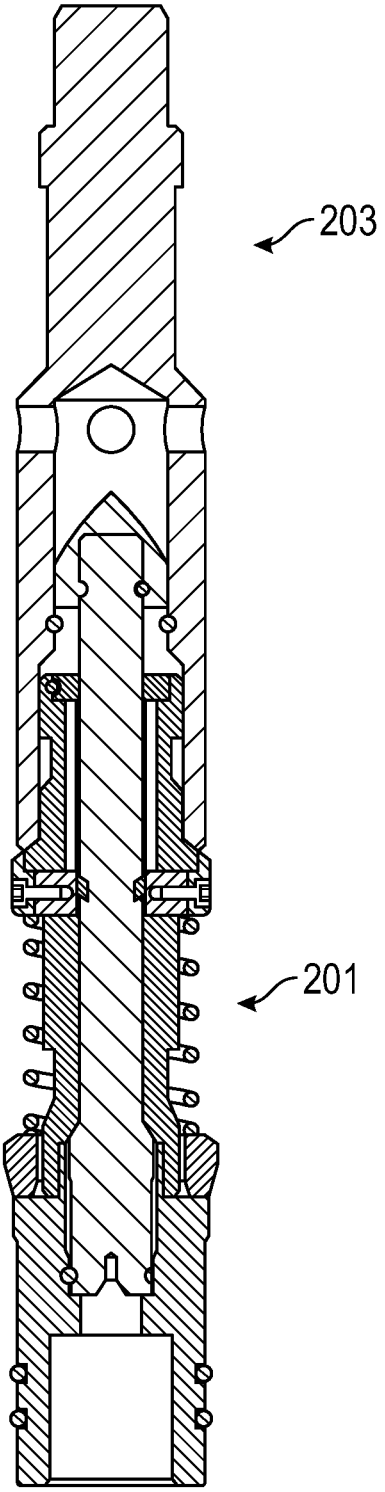
FIG. 10 illustrates a longitudinal cross-section of an example latch according to the present disclosure coupled to a running tool.

FIGS. 5-6B, 7, and 8 illustrate example latches 201 according to the present disclosure. As shown, latches according to the present disclosure replace the shear pin 220 of the standard latch with a dog or collet assembly 230. Compared to the shear pin 220, the dog assembly is more robust and can withstand higher mechanical loads and cyclic loading, which could cause the shear pin 220 to fail. These latches can be installed via the same process and running tool 203 as a standard latch (such as the latch shown in FIGS. 2-4), for example as shown in FIG. 10.

Figure 6A:
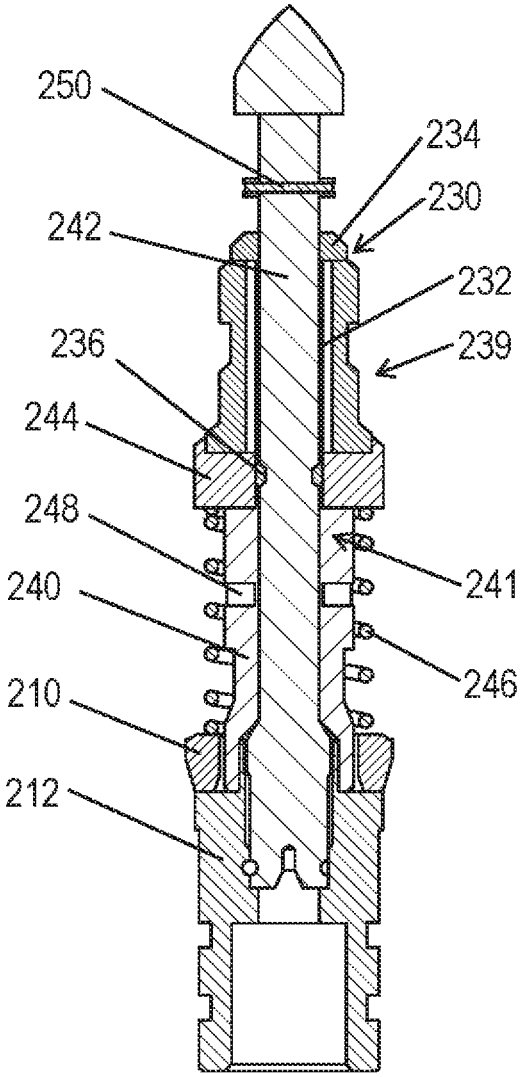
FIG. 6A illustrates a longitudinal cross-section of the latch of FIG. 5 in a locked position.
Figure 6B:
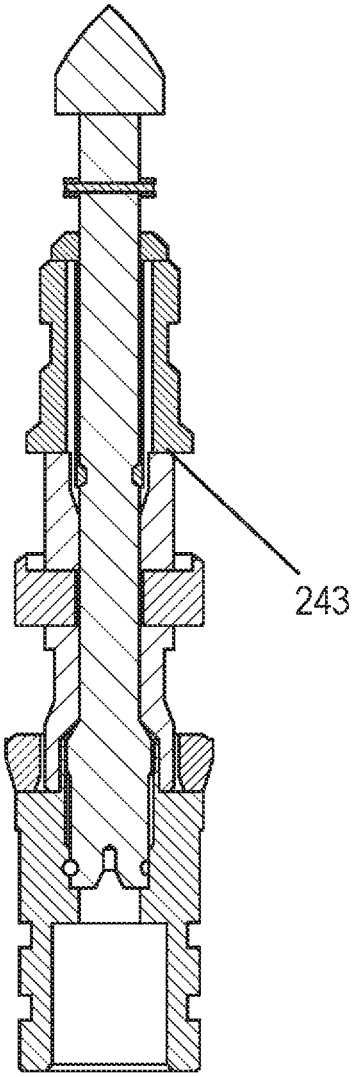
FIG. 6B illustrates a longitudinal cross-section of the latch of FIG. 5 in an unlocked position, with a spring element removed for clarity.

An example configuration of a latch according to the present disclosure, shown in FIGS. 6A-6B, includes an outer latch body 240, a running head 242, a latch ring 210, a latch stop 212, a lock ring 244, and a dog assembly 230. The latch stop 212 can form a base or bottom of the latch. For use, a downhole component, such as a valve 170, can be partially received in and/or secured to the latch stop 212. The running head 242 is disposed within (radially within) and extends through (longitudinally or axially through) the latch body 240. A lower end or portion of the running head 242 can extend into and/or be coupled to the latch stop 212. A lower end or portion of the latch body 240 can be coupled to and/or disposed adjacent the latch stop 212. The latch ring 210 is disposed about (radially or circumferentially about) the latch body 240. The latch ring 210 can be positioned at, adjacent, or proximate a lower or downhole end of the latch body 240. In the illustrated configuration, the latch ring 210 is disposed adjacent and/or contacts a portion of the latch stop 212. As shown, the latch body 240 can include an upper portion 239 and a lower portion 241. The upper 239 and lower 241 portions can be a single monolithic component, or two components coupled (e.g., permanently coupled or integrally formed) together. A lower or downhole facing edge of the upper portion 239 can form a shoulder 243 (shown in FIG. 6B). A spring 246 is disposed radially or circumferentially about the lower portion 241.

In some configurations, for example as shown in FIGS. 6A-8, the latch includes a locking mechanism 248 positioned along an outer surface of the lower portion 241. Some configurations lack a locking mechanism 248, as shown in the configuration of FIG. 9. In some configurations, as shown in FIGS. 6A-6B the latch includes a safety mechanism 250 positioned along or about the running head 242 above the latch body 240. The configurations of FIGS. 7-9 do not include a safety mechanism 250.

The dog assembly 230 includes a shaft or body 232 disposed radially between the latch body 240 and the running head 242. In some configurations, the dog assembly 230 is assembled with the latch body 240. The latch body 240 and dog assembly 230 can be held together, for example with a pin. An upper or uphole end of the shaft 232 can include or form a flange 234 that has a greater diameter or extends radially outward beyond or to a greater extent than a remainder of the shaft 232. As shown, the flange 234 can be positioned above and outside of the latch body 240 and can be positioned adjacent or proximate an upper or uphole end of the latch body 240. In other configurations, for example as shown in FIG. 9, the flange 234 is disposed radially within the latch body 240. An upper edge or surface of the flange 234 can be flush with the upper end of the latch body 240 as shown, or may be recessed below the upper end of the latch body 240. The flange 234 can help secure the dog assembly 230 relative to the latch body 240. A lower or downhole end of the shaft 232 includes or forms one or more dogs 236 protruding radially inward from and relative to an inner surface of the shaft 232. The dogs 236 are sized, shaped, positioned, and/or configured to engage the running head 242, for example, corresponding features in an outer surface of the running head 242.

The lock ring 244 is disposed about (radially or circumferentially about) the latch body 240, for example, the lower portion 241 of the latch body 240 in the illustrated configuration. The lock ring 244 can be formed as a single piece or multiple pieces as shown in FIG. 9. In some configurations, a majority of the lower portion 241 of the latch body 240 can have a reduced diameter compared to the upper portion 239. The lower portion 241 can include one or more rails 252 (shown in FIG. 5). In some configurations, the rails 252 project outwardly from and have a greater axial width than the majority of the lower portion 241. The lock ring 244 can have one or more corresponding channels or features formed in its inner surface and configured to receive and slide along the rail(s) 252. The dog assembly shaft 232 can be longer than the upper portion 239 such that the dogs 236 extend beyond and are positioned below the upper portion 239. The lower portion 241 can include one or more longitudinally extending channels 254 circumferentially aligned with or in the area of the dogs 236. The lock ring 244 can include corresponding projections (or radially thicker portions) extending inwardly from the inner surface of the lock ring 244, for example, into the channels 254. The projections prevent or inhibit the dogs 236 from moving or flexing too far radially outward and/or leaving the corresponding features in the running head 242 and/or the channels 254 in the lower portion 241 of the latch body 240. In some configurations, the lock ring 244 contacts the dogs 236. The spring 246 can extend between and contact the latch ring 244 and the shoulder 243 of the upper portion 239.

In use, for example, during installation and/or operation of the valve, movement of the latch and valve assembly is transferred to force on the latch, with the load path through the dog assembly 230 (compared to the shear pin in the design of FIG. 1). In a locked position, the lock ring 244 is positioned longitudinally aligned with and radially or circumferentially about the dogs 236, as shown in FIG. 6A. In the locked position the lock ring 244 keeps the dog(s) 236 engaged with corresponding features in the running head 242. This arrangement advantageously provides increased robustness and allows the latch to withstand greater forces and more cycles than a traditional shear pin design, as shown in FIG. 1.

Figure 11A:
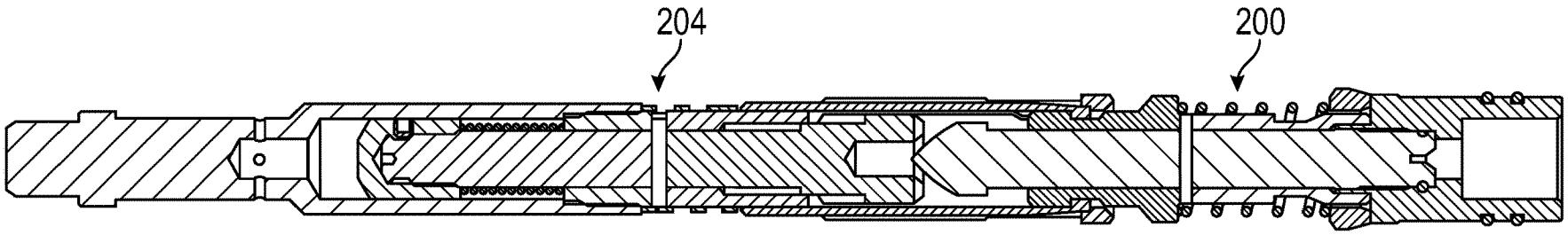
FIG. 11A illustrates the latch of FIG. 2 coupled to an existing pulling tool.
Figure 11B:
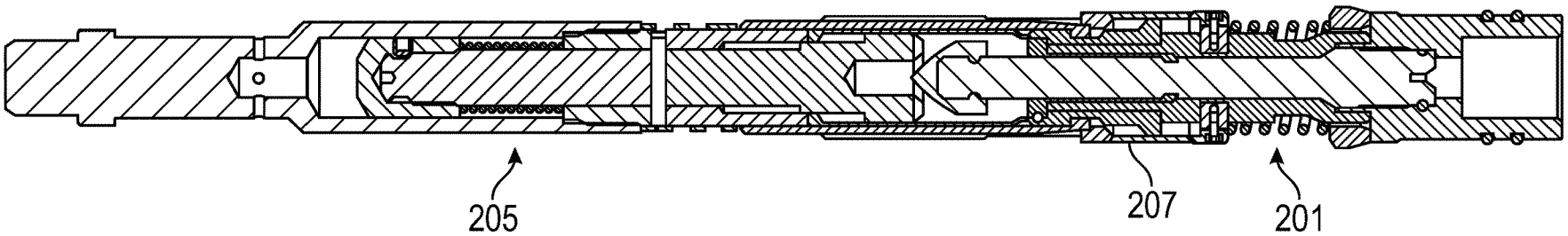
FIG. 11B illustrates an example latch according to the present disclosure coupled to a modified pulling tool.

To retrieve a latch and valve assembly according to the present disclosure, a modified pulling tool is used. FIG. 11A shows a conventional available pulling tool 204 used to retrieve a conventional latch such as latch 200. FIG. 11B shows a modified pulling tool 205 design to retrieve a latch according to the present disclosure, such as latch 201. As shown, the pulling tool 205 includes a distal sleeve 207 coupled to a lower end of the tool 205. The distal sleeve 207 is configured to contact the lock ring 244 during retrieval.

During retrieval, the pulling tool 205, e.g., the distal sleeve 207, pushes the lock ring 244 down, for example past the locking mechanism 248 if present, during a standard "jar down" process. In some configurations, features of the lock ring 244 (for example, on or in the inner surface of the lock ring 244) engage corresponding features of the locking mechanism 248 to retain the lock ring 244 in an unlocked position, shown in FIG. 6B (with the spring 246 removed for clarity). With the lock ring 244 in the unlocked position, the collet is unsupported and the dogs 236 are able to move radially outward and disengage from the running head 242. The pulling tool 205 pulls upward on the latch body 240, driving the dogs 236 outward and allowing the latch body 240 and dog assembly 230 to move upward together, for example, relative to the running head 242. When the latch body 240 is supporting the latch ring 210, the valve and latch assembly is kept latched into the mandrel 150. When the latch body 240 moves upward enough to disengage from and clear (rise above) the latch ring 210, the unsupported latch ring 210 can move or contract toward the inner diameter of the latch and away from the mandrel lug 152, thereby releasing the valve and latch assembly from the mandrel 150.

In some configurations including the safety mechanism 250, with the lock ring 244 in an unlocked position, the latch body 240 and dog assembly 230 move upward until they shoulder against the safety mechanism 250. Further pulling with the pulling tool 205 shears a shear pin in the safety mechanism 250, allowing the latch body 240 to move far enough upward to fully disengage from the latch ring 210 and release the valve and latch assembly.

Figure 5:
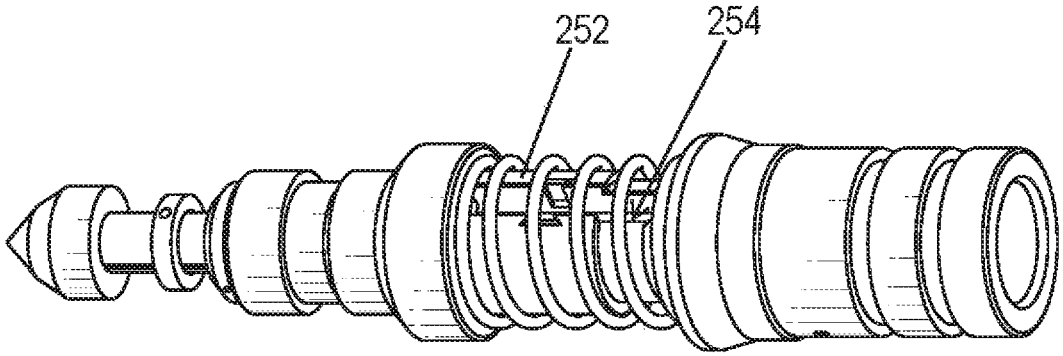
FIG. 5 illustrates a perspective view of an example latch according to the present disclosure.
Figure 7:
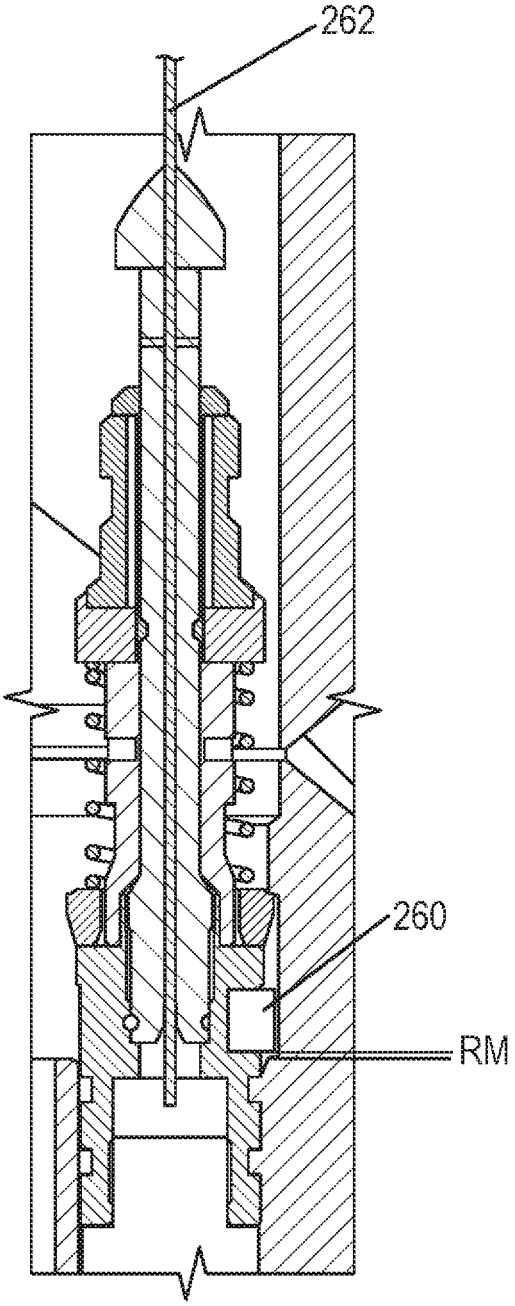
FIG. 7 illustrates a longitudinal cross-section of another example latch according to the present disclosure.

FIG. 7 illustrates another configuration of a latch according to the present disclosure that can share or include some or all of the features shown in and described with respect to FIGS. 5-6B. The configuration of FIG. 7 includes one or more locking dogs 260 disposed in or on or coupled to the latch stop 212, and an operating rod 262 extending longitudinally through the running head 242 and extending out of the top of the latch. During installation of the latch and downhole component (e.g., valve), the locking dogs 260 are held internally in the latch stop 212 or held in a retracted position. Once the latch and valve assembly is installed and held in place in the mandrel 150 by the latch ring 210 engaging or contacting the mandrel lug 152, the installation tool pulls on the operating rod 262. Pulling the operating rod 262 releases the locking dogs 260 into an expanded or deployed position in which the locking dogs 260 extend into an annular space between the mandrel 150 and the latch 201. The locking dogs 260 help significantly reduce the range of movement RM allowed, for example during dynamic pressure changes. This reduction in the range of movement reduces impact loads on the latch.

Figure 8:
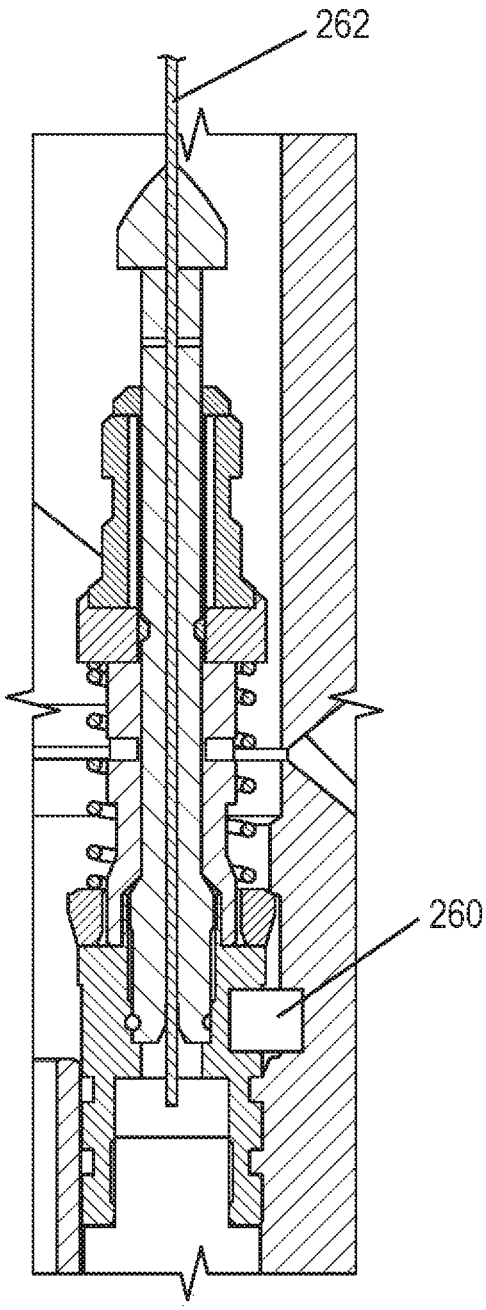
FIG. 8 illustrates a longitudinal cross-section of another example latch according to the present disclosure.
Figure 9:
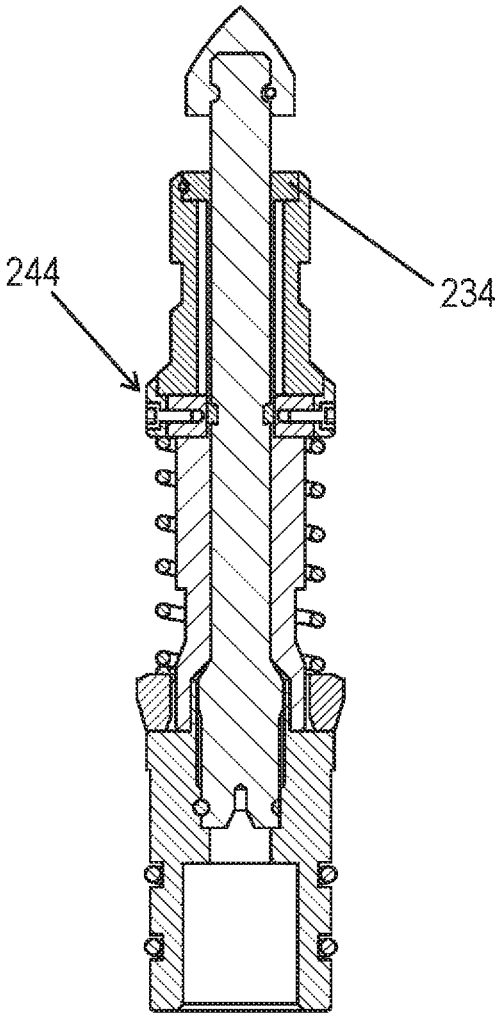
FIG. 9 illustrates a longitudinal cross-section of another example latch according to the present disclosure.

FIG. 8 illustrates another configuration of a latch according to the present disclosure that can share or include some or all of the features shown in and described with respect to FIGS. 5-6B. The configuration of FIG. 8 includes one or more locking dogs 260 similar to the configuration of FIG. 7. However, in the configuration of FIG. 8, when in the expanded or deployed position, the locking dogs 260 engage the mandrel 150 to secure or lock the latch to or relative to the mandrel 150. Various mechanisms can be used to deploy the locking dogs 260 and/or secure the locking dogs 260 to the mandrel 150, for example, teeth on the locking dogs 260, energized elastomeric components, energized polymer components, and/or chemical reaction(s) to create an expanding material.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately," "about," "generally," and "substantially" may refer to an amount that is within less than 10% of, within less than 5% of, within less than 1% of, within less than 0.1% of, and/or within less than 0.01% of the stated amount. As another example, in certain embodiments, the terms "generally parallel" and "substantially parallel" or "generally perpendicular" and "substantially perpendicular" refer to a value, amount, or characteristic that departs from exactly parallel or perpendicular, respectively, by less than or equal to 15 degrees, 10 degrees, 5 degrees, 3 degrees, 1 degree, or 0.1 degree.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims. It is also contemplated that various combinations or sub-combinations of the specific features and aspects of the embodiments described may be made and still fall within the scope of the disclosure. It should be understood that various features and aspects of the disclosed embodiments can be combined with, or substituted for, one another in order to form varying modes of the embodiments of the disclosure. Thus, it is intended that the scope of the disclosure herein should not be limited by the particular embodiments described above.

What is claimed is:

1. A latch for a downhole component, the latch comprising:

a latch stop forming a base of the latch;

a running head coupled to and extending upward from the latch stop;

a latch body circumferentially disposed about at least a portion of the running head;

a latch ring disposed circumferentially about the latch body and positioned adjacent the latch stop;

a dog assembly comprising a shaft disposed radially between the running head and the latch body and one or more dogs disposed at a bottom end of the shaft, the dogs configured to engage corresponding features in the running head; and a lock ring disposed circumferentially about the latch body, wherein in a locked position, the lock ring is positioned at an axial position along the latch body such that the lock ring is radially aligned and disposed about the one or more dogs, the lock ring configured to inhibit the one or more dogs from moving radially outward out of engagement with the corresponding features in the running head, and wherein in an unlocked position, the lock ring is positioned along the latch body axially spaced from the one or more dogs, thereby allowing the one or more dogs to move radially outward out of engagement with the running head.

2. The latch of claim 1, the latch body comprising a locking mechanism configured to engage the lock ring in the unlocked position.

3. The latch of claim 1, further comprising a safety mechanism positioned along the running head above the latch body.

4. The latch of claim 1, wherein the downhole component is configured to be partially received in the latch stop.

5. The latch of claim 1, wherein the latch is configured to couple to a running tool for insertion into a wellbore.

6. The latch of claim 1, wherein the downhole component is a gas lift valve.

7. The latch of claim 1, further comprising one or more locking dogs coupled to the latch stop.

8. The latch of claim 7, wherein when the latch and downhole component are installed in a downhole mandrel, the locking dogs are configured to radially expand to a deployed position to limit an axial range of movement of the latch and downhole component in the mandrel.

9. The latch of claim 8, wherein in the deployed position, the locking dogs are configured to engage the mandrel.

10. A method for retrieving the latch of claim 1 coupled to a downhole component from a mandrel disposed in a wellbore, the method comprising:

running a pulling tool downhole to contact the latch;

pushing the lock ring downward along the latch body to the unlocked position using the pulling tool; and allowing the one or more dogs to move radially outward out of engagement with the running head.

11. The method of claim 10, further comprising using the pulling tool to pull upward on the latch body, driving the one or more dogs radially outward.

12. The method of claim 11, further comprising pulling the latch body and dog assembly upward such that the latch body disengages from and clears the latch ring, allowing the latch ring to move radially inward out of engagement with a lug of the mandrel.

13. The method of claim 12, further comprising removing the latch and downhole component from the mandrel and wellbore.

* * * * *